US005575048A

United States Patent [19]

Ruef

[11] Patent Number: 5,575,048

[45] Date of Patent: Nov. 19, 1996

[54] APPARATUS FOR TREATING TRAVELING TEXTILE MATERIAL HAVING EXPANSION CHAMBERS

[76] Inventor: Helmut Ruef, 10173 Foxhall Dr., Charlotte, N.C. 28210

[21] Appl. No.: 358,519

[22] Filed: Dec. 19, 1994

[51] Int. Cl.[6] ..... D02G 1/00; F26B 3/00

[52] U.S. Cl. ..... 28/219; 28/247; 34/634

[58] Field of Search ..... 28/217, 219, 220, 28/247, 248, 249, 258; 34/634, 629, 242; 68/5 E; 277/53, 54

[56] References Cited

U.S. PATENT DOCUMENTS

| | | | |
|---|---|---|---|
| 2,571,815 | 10/1951 | Benoit et al. | 34/242 |
| 3,349,578 | 10/1967 | Greer et al. | 34/242 |
| 4,087,992 | 5/1978 | Sando et al. | 34/242 |
| 4,980,979 | 1/1991 | Wedel | 34/23 |
| 5,287,606 | 2/1994 | Ruef | 28/219 |

FOREIGN PATENT DOCUMENTS

| | | | |
|---|---|---|---|
| 2029258 | 12/1971 | Germany | 28/62 |

*Primary Examiner*—C. D. Crowder
*Assistant Examiner*—Larry D. Worrell, Jr.
*Attorney, Agent, or Firm*—Shefte, Pinckney & Sawyer

[57] ABSTRACT

An apparatus for treating traveling textile material in a pressurized fluid includes a housing divided into a plurality of expansion chambers and a centrally located treatment chamber through which the material is caused to travel and in which pressurized treatment fluid is applied to the material, the pressurized treatment fluid expanding progressively outwardly through the expansion chambers by way of the material passageways. The material passageways are formed with their smallest dimension at least eight times smaller than the smallest dimension of the expansion chambers to achieve the necessary pressure drop without sealing.

15 Claims, 6 Drawing Sheets

APPARATUS FOR TREATING TRAVELING TEXTILE MATERIAL HAVING EXPANSION CHAMBERS

BACKGROUND OF THE INVENTION

The present invention relates generally to an apparatus for treating a traveling textile material, either filaments or other strand-like material in tows, warps, or single filaments, and, more particularly, to an apparatus for heating traveling textile material to a heat-set or draw point localization temperature in a pressurized saturated or superheated steam atmosphere, such as preliminary to a texturizing or crimping operation, or otherwise to help stabilize the draw point conditions in a synthetic fiber draw process.

In a typical conventional apparatus for drawing, annealing and texturizing textile material, a heating apparatus is provided through which the strand is directed to travel preliminarily to elevate the temperature of the strand to a predetermined draw point or heat-set temperature. Typically, such strands are stretched with a localized draw point for uniform stretching to increase the tenacity of the fabric. After stretching, the strands undergo annealing or heat setting to stabilize the fibers after the draw point to set the fibers and reduce shrinkage to improve fiber uniformity and reliability.

One of the more common heating apparatus utilized for this purpose is a contact heater wherein the strand travels over a heating plate or heated rolls whose temperature are controlled to approximate the desired heat-set temperature. The temperature to which the strand is heated is a function not only of the temperature of the heating plate or roll itself, but also the time spent by a strand portion within the heater, which is determined by the traveling speed of the strand and the length of the heating plate, or the contact length of the rolls.

In recent years, the textile industry has increasingly demanded draw-texturizing/crimping equipment capable of operating at ever higher strand traveling speeds, which objective has been addressed in basically two ways. First, draw-texturizing/crimping equipment has been offered with heating apparatus of increasing lengths so as to prolong fabric Contact with the heaters and, in turn, sufficient heating to a desired heat-set temperature at increased strand traveling speeds. Secondly, draw-texturizing/crimping equipment has become available utilizing heaters which generate a considerably higher strand-heating temperature than the desired heat-set temperature so as to accomplish sufficient strand heating within a shorter strand traveling distance while the strand travels at an increased rate of speed. In a typical conventional apparatus for drawing and heatsetting textile strands, the strands are heated by hot air, steam at atmospheric pressure, heated rolls or hot plates.

Disadvantages exist in all types of heating apparatus, particularly the hot plate and roll annealer because of their space requirements, high cost, difficulty of surface cleaning from oligomers and finish oils and melting at machine stops. Problems also exist with hot air ovens and atmospheric steam ducts due to their ineffective heat transfer capabilities which typically result in very large machines.

In texturizing equipment utilizing shorter length heaters operable at more elevated temperatures, often in the range of up to 600° C., substantially greater energy must be generated to accomplish heating to such elevated temperatures, thereby correspondingly increasing the cost of equipment operation. Further, a greater risk exists in operating such equipment that the cross section of the textile material can be rendered non-uniform by crystallizing the outermost portions of the strand to a greater degree than the strand core. In addition, due to periodic stoppages of the equipment, further damage to the material may occur by melting caused by prolonged contact with the heater. Therefore, it is critical in such equipment that the temperature of the heater and the traveling speed of the strand be closely monitored and carefully controlled to minimize these risks.

Similar disadvantages exist in conventional commercial equipment for heat-setting carpet yarns, wherein the objective is to stabilize the yarn bulk, to return the yarn to a fully relaxed state by relieving inner molecular tension within the yarn structure, and to increase its crystalinity for better and more uniform die pickup. For this purpose, commercial yarn heat-setting equipment typically accomplish heat setting by directing the yarn to travel in a low tensioned state through a dry heat atmosphere or in a steam atmosphere at ambient pressure or a slightly elevated pressure. However, since the steam atmosphere generated in such equipment is typically at a temperature below a desired heat-setting temperature and since heat transfer from a dry heat atmosphere to a traveling strand is relatively inefficient, such conventional heat-setting equipment must be of a relatively significant length to achieve a sufficient dwell time of the traveling carpet yarn within the heater to obtain the desired heat-setting results.

SUMMARY OF THE INVENTION

It is accordingly an object of the present invention to provide an apparatus by which a traveling textile material, such as yarns, in tow form, warp form or as individual strands, and other textile material such as wovens or fabrics or other textile materials in web form or flat form can be effectively and efficiently heat-set while traveling at a relatively high linear speed without requiring the heat-setting equipment to be of a significant length and without subjecting the textile material to a significant risk of damage while providing an apparatus that is simple and inexpensive to construct and operate.

According to the present invention, this objective is accomplished by providing an apparatus wherein a traveling textile material can be treated in a pressurized fluid, the apparatus being particularly useful for heat-setting traveling textile material formed as strands in, tow, warp or single strand form, in a pressurized saturated or superheated steam atmosphere.

Briefly summarized, the apparatus of the present invention basically includes a housing structure which defines a series of expansion chambers through which the textile material can be directed to travel in succession. A central treatment chamber is provided within the housing which is communicated with a supply of suitable pressurized material treating fluid, e.g., saturated or superheated pressurized steam. The housing includes a textile material inlet and a textile material outlet.

To allow the use of pressurized, saturated or superheated steam in the treatment chamber without sophisticated sealing arrangements and in a safe environment, a plurality of expansion chambers are disposed within the housing, each having a textile material passageway formed therein. The expansion chambers are disposed upstream and downstream of the treatment chamber and fluid communication therewith for the successive expansion of the treatment fluid between the treatment chamber and the atmosphere. Each textile material passageway has an opening formed with a predetermined cross sectional dimension and each expansion chamber is formed with predetermined dimensions according to a predetermined ratio of passageway size relevant to expansion chamber size for maintaining a pressure drop across each of the expansion chambers. Preferably, each passageway is of increasing dimension in the direction outwardly away from the treatment chamber to act as a diffuser and to promote expansion within the expansion chambers of the pressurized treating fluid escaping thereinto.

The present invention also includes an arrangement for delivering pressurized treatment fluid to the treatment chamber including a treatment fluid holding chamber disposed in the housing in fluid communication with the treatment chamber. Preferably, the fluid holding chamber is disposed in a top and bottom lid of the housing and is in fluid communication with the treatment chamber. Since the fluid pressure in this chamber is always greater than the pressure in the treatment chamber, resulting in a higher temperature, condensation on the top and bottom of the treatment chamber is effectively avoided. Each expansion chamber has at least one cross sectional dimension which is at least ten times greater than the smallest cross sectional dimension of each passageway opening. The textile material inlet may include an opening formed in one end of the housing for passage therethrough of the traveling textile material and a door assembly for at least partially covering the inlet opening, the door assembly being movable between an opened position for feeding textile material through the housing and a closed position wherein the door at least partially covers the inlet opening and forms a passageway for free movement of textile material therethrough. Preferably, the door forms a passageway sized in conformance with the predetermined ratio. A similar arrangement is formed at the outlet opening.

According to another preferred embodiment of the present invention, at least one of the expansion chambers includes a constriction arrangement for selectively changing the size of the textile material passageway opening formed in the expansion chamber to selectively control the pressure drop within the chamber by changing the size of the opening relative to the size of the expansion chamber. The constriction assembly preferably includes a pair of panels movably mounted to the housing for selective movement in and out of a covering relation with the textile material passageway for decreasing or increasing the effective size of the textile material passageway.

In another preferred embodiment of the present invention, the housing includes a lower housing portion and an upper housing portion hingedly mounted thereto and selectively movable between an opened position for insertion of textile material in said housing for treatment operations and a closed position for ongoing treatment operations. In this situation, the housing includes a sealing arrangement for sealing the junction of the upper housing portion and the lower housing portion for preventing treatment fluid from escaping at the junction.

Preferably, the present invention includes an assembly for feeding textile material through the treatment chamber. This may be in the form of an endless conveyor having a movable material support surface extending through the housing. Additionally, the feeding assembly may include at least two endless conveyors, each endless conveyor having a movable material support surface extending through the housing whereby the apparatus can treat at least two distinct textile materials substantially simultaneously. Alternatively, the feeding assembly may include at least two pairs of nip rollers, one pair being disposed adjacent the textile material inlet while the other pair is disposed adjacent the textile material outlet, for directing the textile material through the housing. Further, the feeding assembly may include an assembly for moving the textile material between the nip rollers and through the housing.

It is further preferred that at least one of the expansion chambers includes an arrangement for removing treatment fluid therefrom and directing the treatment fluid away from the housing. As is preferred, the treatment chamber and the expansion chambers are arranged in a series arrangement and the treatment fluid removal arrangement is configured for removing treatment fluid from the first and last expansion chambers in the series arrangement. This allows the user to bleed off excess steam at a reduced pressure for additional applications elsewhere.

According to the present invention, even at very low fluid pressures, by expanding the fluid through the passageways, an effective countercurrent flow is obtained in the feed zone in addition to a co-current flow in the discharge zone, thereby enhancing the heat transfer of the fluid with the textile media.

By the above, the present invention provides a simple, safe apparatus for the steam treatment of traveling textile material wherein the pressure drop between the treatment chamber and the atmosphere may be selectively controlled without resort to complicated sealing arrangements.

DETAILED DESCRIPTION OF THE PREFERRED EMBODIMENTS

Figure 1:
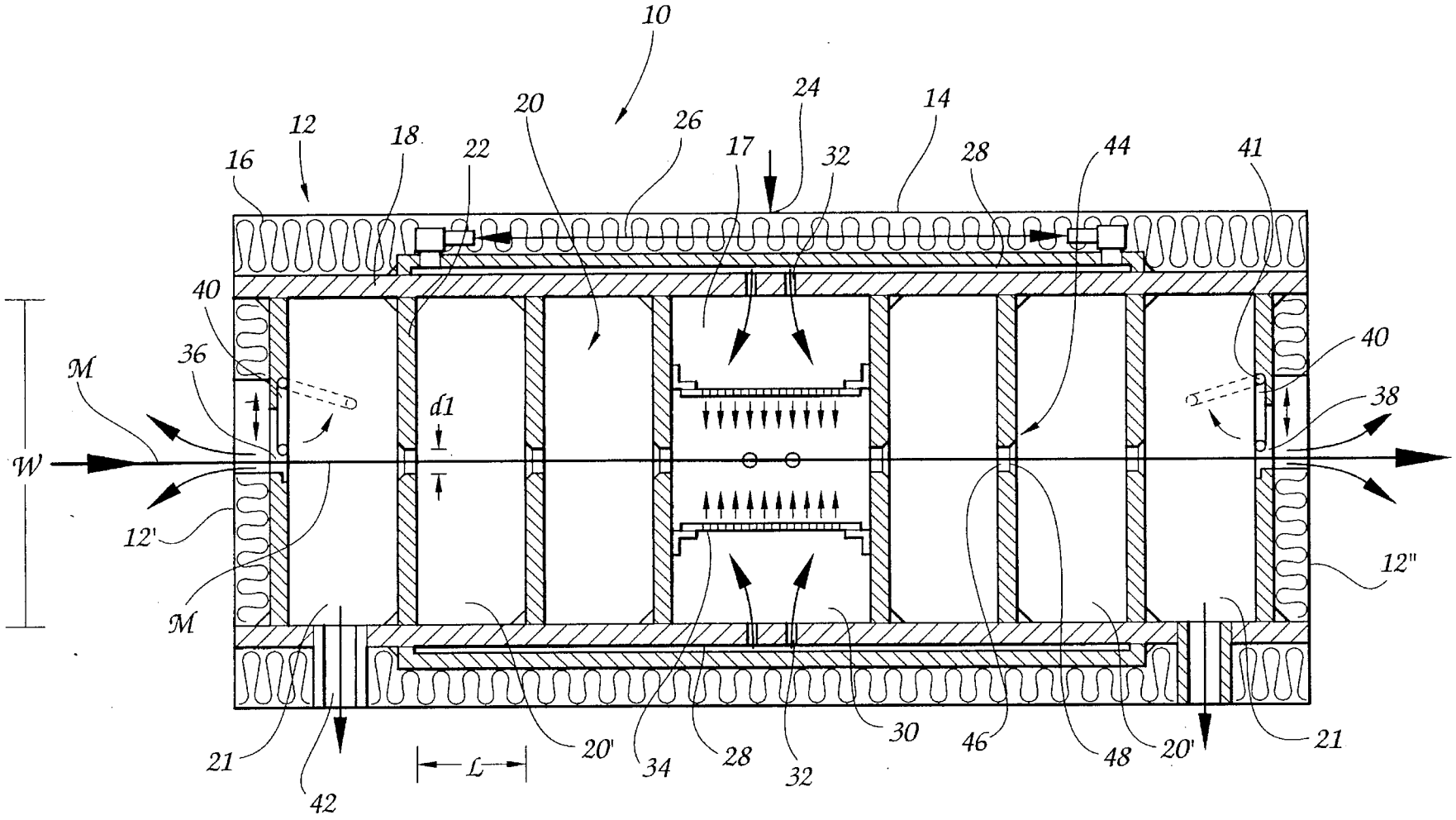
FIG. 1 is a schematic lengthwise cross-sectional view of a textile material treating apparatus according to the preferred embodiment of the present invention.

Referring now to the accompanying drawings and initially to FIG. 1, an apparatus for treating a traveling textile material in a pressurized fluid environment according to a preferred embodiment of the present invention is indicated generally at 10. It is contemplated that the present invention is susceptible to differing embodiments for treating a variety of textile materials, which may include filaments, yarns, and other strand-like materials as well as tapes, webs, tows, warps, coarse multifilaments and woven fabric, utilizing a variety of possible treating fluids, e.g., saturated and superheated steam. The invention is herein illustrated and described in embodiments adapted for pressurized and superheated steam heat-setting of any of the above-described fabrics, but it is to be understood by those persons skilled in the art that the invention is of a broader utility and application.

Basically, the apparatus 10 comprises a housing structure 12 having an elongate outer shell 14 separated from an inner shell 18 by insulating material 16. The housing 12 is basically rectangular or round in structure and is configured for passage therethrough of a traveling textile material M from an upstream end 12' to a downstream 12". To that end, a textile material inlet 36 is disposed at the upstream end 12' and a textile material outlet 38 is formed in the downstream end 12" of the housing 12. The housing 12 is divided into a series of interior chambers by a plurality of walls 22 extending the width of the housing 12. In the center of the housing 12, a treatment chamber 17 is provided for application of treatment fluid to the traveling textile material. Progressing outwardly in either direction from the treatment chamber 17, a plurality of expansion chambers 20 are provided for the pressure reduction of the pressurized treatment fluid from a higher pressure environment inside the treatment chamber 17 to an atmospheric environment outside of the housing 12. Steam is provided through a steam inlet 24 through the outer shell 14 into conventional steam piping 26 which is communicated with a steam jacket 28 which surrounds at least the treatment chamber 17 and preferably extends in either direction therefrom to the extent necessary to provide a sufficient volume to hold a sufficient amount of steam. The steam jacket 28 communicates with the treatment chamber 17 at a plurality of locations, e.g., through a pair of bores 32 extending transversely therebetween at an axial spacing through the inner housing 18. The steam jacket 28 provides an intermediate holding area for the steam before it passes into the treatment chamber 17 ensuring that the steam temperature in the steam jacket 28 is always at least slightly higher than in the pressure and expansion chambers 17,20, thereby significantly reducing the occurrence of condensation therein. Under some circumstances, excess condensation could leave deposits of finishing oils, polymers, and other residue from the textile material on the walls of the chambers which would require frequent cleaning of the interior of the apparatus 10. A pair of diffuser screens 34 are disposed within the treatment chamber 17 to provide a uniform application of steam to the traveling textile material.

In order to serve the dual purpose of passing the textile material through the apparatus 10 and allowing the steam to escape from the treatment chamber 17 into the expansion chambers 20 the passageways in the wall members 22 are preferentially but not essentially formed as diffusers with a narrow portion 46 directed toward the higher pressure area and an expanded, chamfered portion directed toward the outlets. In this way, the steam is encouraged to expand as it passes from one chamber 20 to the next.

In order to achieve the desired pressure drop across the chambers, certain dimensioning aspects of the passageways 44 relevant to the chambers 20 are required. Specifically, the largest dimension of the passageway 44 should be at least eight times smaller than the largest dimension of the expansion chamber 20. Referring to FIG. 1, distance d1 must be eight times smaller than either W or L. Then, the desired pressure drop is achieved without resort to complicated sealing assemblies.

The outermost expansion chambers 21 are equipped with a steam escape passageway 42 which bleeds off the steam in those chambers 21 to reduce the amount of spray at the inlet 36 and the outlet 38. The steam drawn from the relief passageways 42 may be applied elsewhere or vented to atmosphere. By way of example, a 100 psi environment in the treatment chamber 17 will be reduced to 80 psi in the first chamber adjacent the treatment chamber 17, subsequently reduced to 50 psi in the second chamber away from the treatment chamber 17 and, finally, to 35 psi in the final chamber 21. This 35 psi steam may be useful for other functions and is available for such use.

In order to enhance the ability of the operator to feed the textile material through the apparatus 10, the inlet 36 is equipped with a flap 40 mounted to the inlet end 12' of the apparatus 10 with a hinge 41. The flap may be then moved away from the inlet 36, thereby enlarging the inlet 36 sufficiently to easily feed material into the apparatus 10. A similar flap 40 is disposed at the outlet end 12" adjacent the textile material outlet 38.

In operation, the flaps 40 are opened and the textile material M is fed into the machine through the passageways 44 and finally out through the outlet 38 using an elongate fishing member or some other conventional threading method. Steam is injected through the steam inlet 24 down the steam lines 26 and into the steam jacket 28 where is expands to fill that cavity before escaping into the treatment chamber 17 through the entry bores 32. By conventional means the material M is caused to travel through the machine at a predetermined rate. As it passes through the treatment chamber steam diffused through the screens 34 is applied uniformly to the traveling material M. This treatment occurs in a pressurized environment, as high as 100 psig and as low as 0.5 psig, and steam is constantly being fed to the treatment chamber 17 to make up for losses through the expansion chambers 20,20',21. The steam within the chamber 17 escapes outwardly in either direction into the first expansion chamber 20 with the pressure drop across the diffuser-like passageway 44 reducing the pressure to atmospheric conditions in the discharge chambers. The steam in the first expansion chamber 20 escapes through the next passageway 44 into the second expansion chamber 20' for a further pressure drop. The steam then escapes through the release passageway 42 to be used elsewhere or to expand into the atmosphere.

Figure 2:
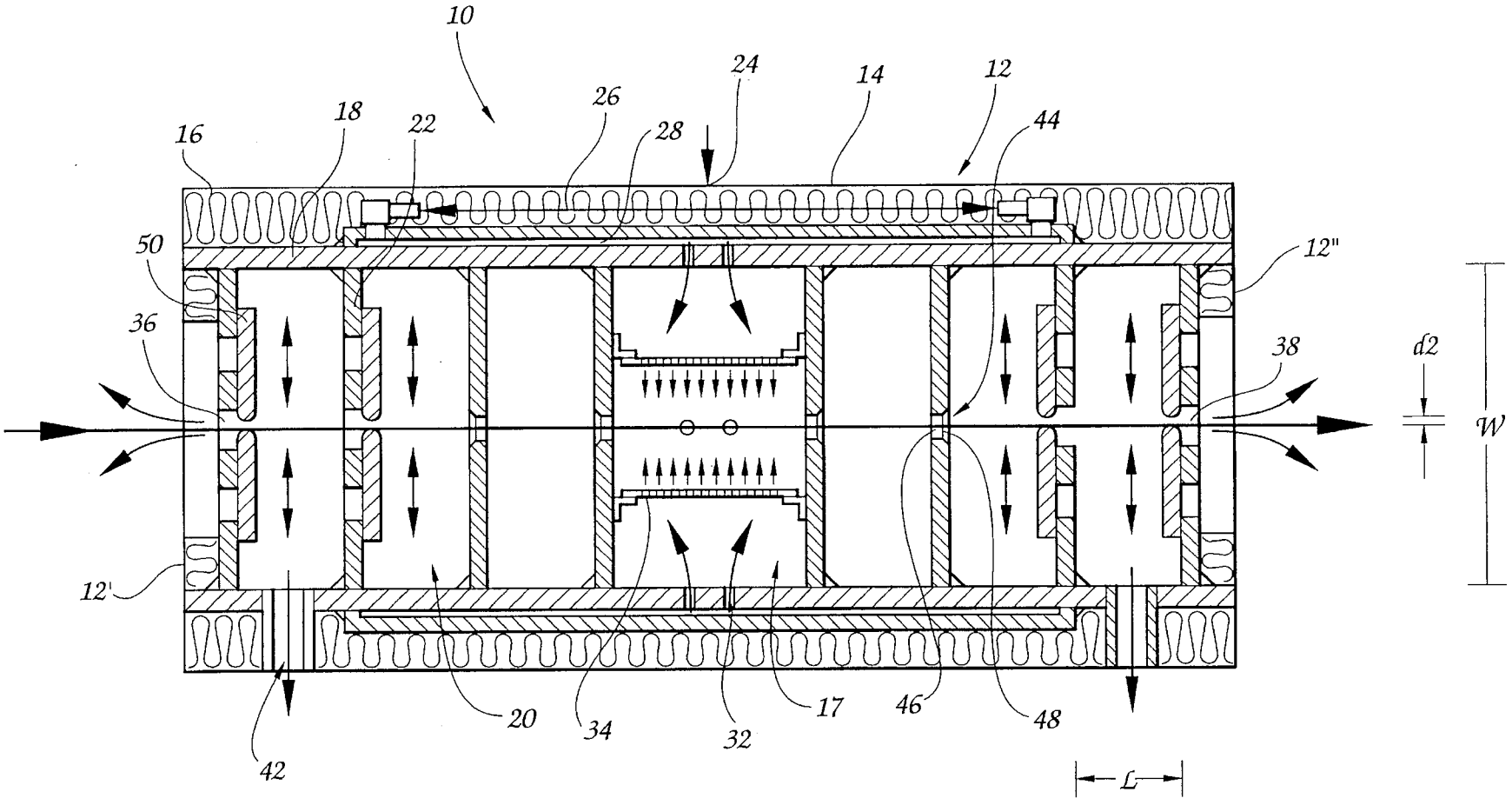
FIG. 2 is another schematic lengthwise cross-sectional view of a textile material treating apparatus according to an alternative embodiment of the present invention.

A second preferred embodiment of the present invention is disclosed in FIG. 2 and is adaptable for more fully controlling the pressure drop between the later stages of steam expansion. To this end, constrictors 50 formed as panels are movably mounted to the inner walls 22 forming the expansion chambers 20,20',21. These constrictor plates 50 are slidable into and out of a covering relation with the material passageway 44 to alter the size of the passageway opening. As previously discussed, the narrow dimension of the passageway must be at least eight times smaller than the smallest dimension of the expansion chambers 20,20',21. By moving the constrictor panels 50 in and out of covering relation with the passageways 44, the critical passageway dimension may be adjusted to provide either an increased or decreased pressure drop. This dimension is illustrated as d2 if FIG. 2.

Figure 3:
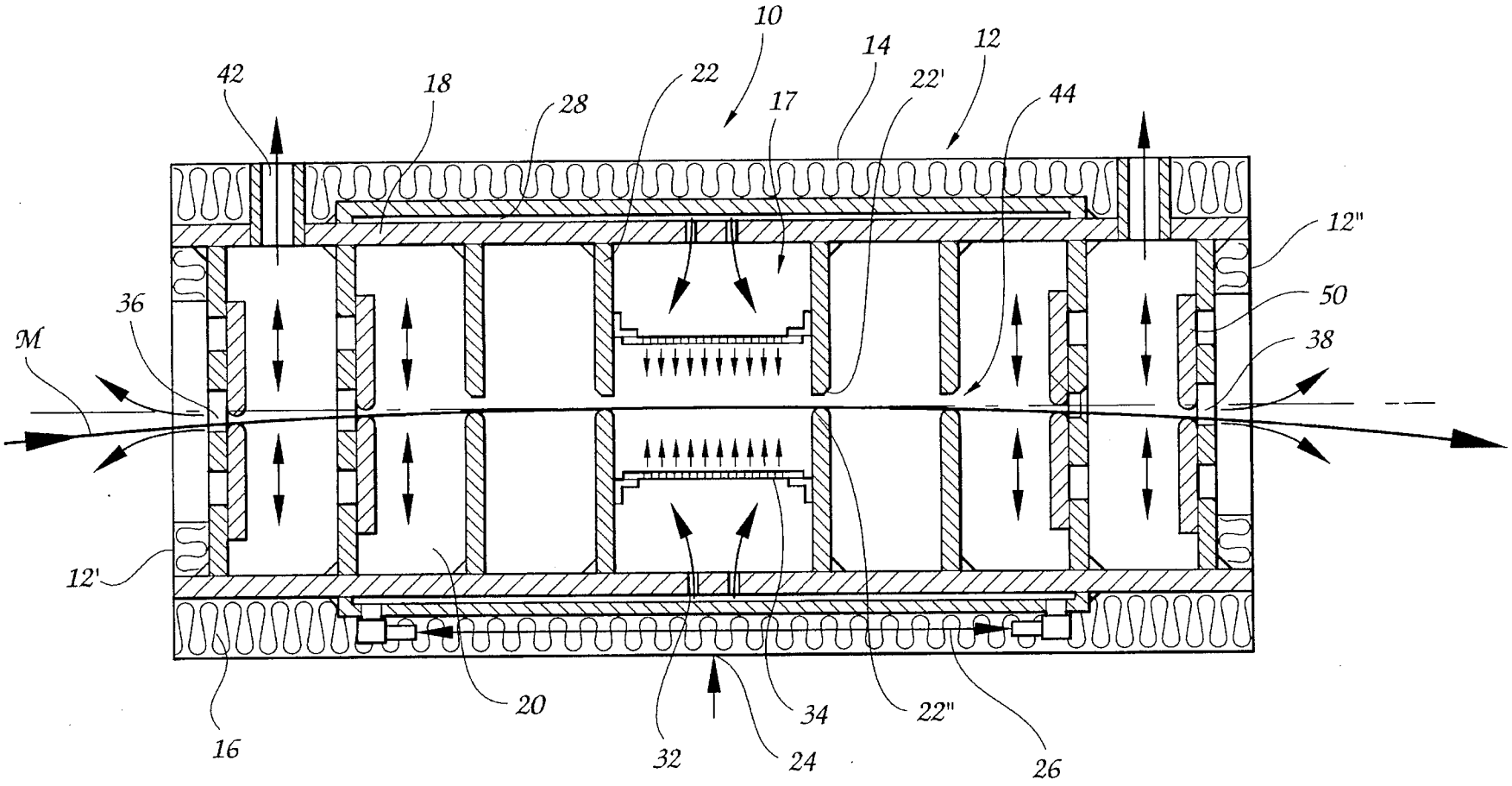
FIG. 3 is another schematic lengthwise cross-sectional view of a textile material treating apparatus according to another alternative embodiment of the present invention.

Another preferred embodiment of the present invention is illustrated in FIG. 3. There, the diffusers are removed from the passageways 44 leaving an opening in each wall 22. The upper portion of the wall 22 adjacent the passageway is formed with a beveled surface 22' directed outwardly away from the treatment chamber 17. This beveling of the wall 22 provides a partial diffusing effect which enhances steam expansion in the successive chambers. The lower portion of the wall 22 is provided with a curved surface 22" over which the material may pass in contact therewith. The rounded surface 22" is provided with a nonabrasive surface so as to prevent fabric damage as the fabric passes thereacross. This version is particularly suited for use with a yarn sheet or other web so that the sheet or web is stabilized as it is drawn through the apparatus to prevent wandering of the sheet. This version is suitable for warp drawing.

Figure 4:
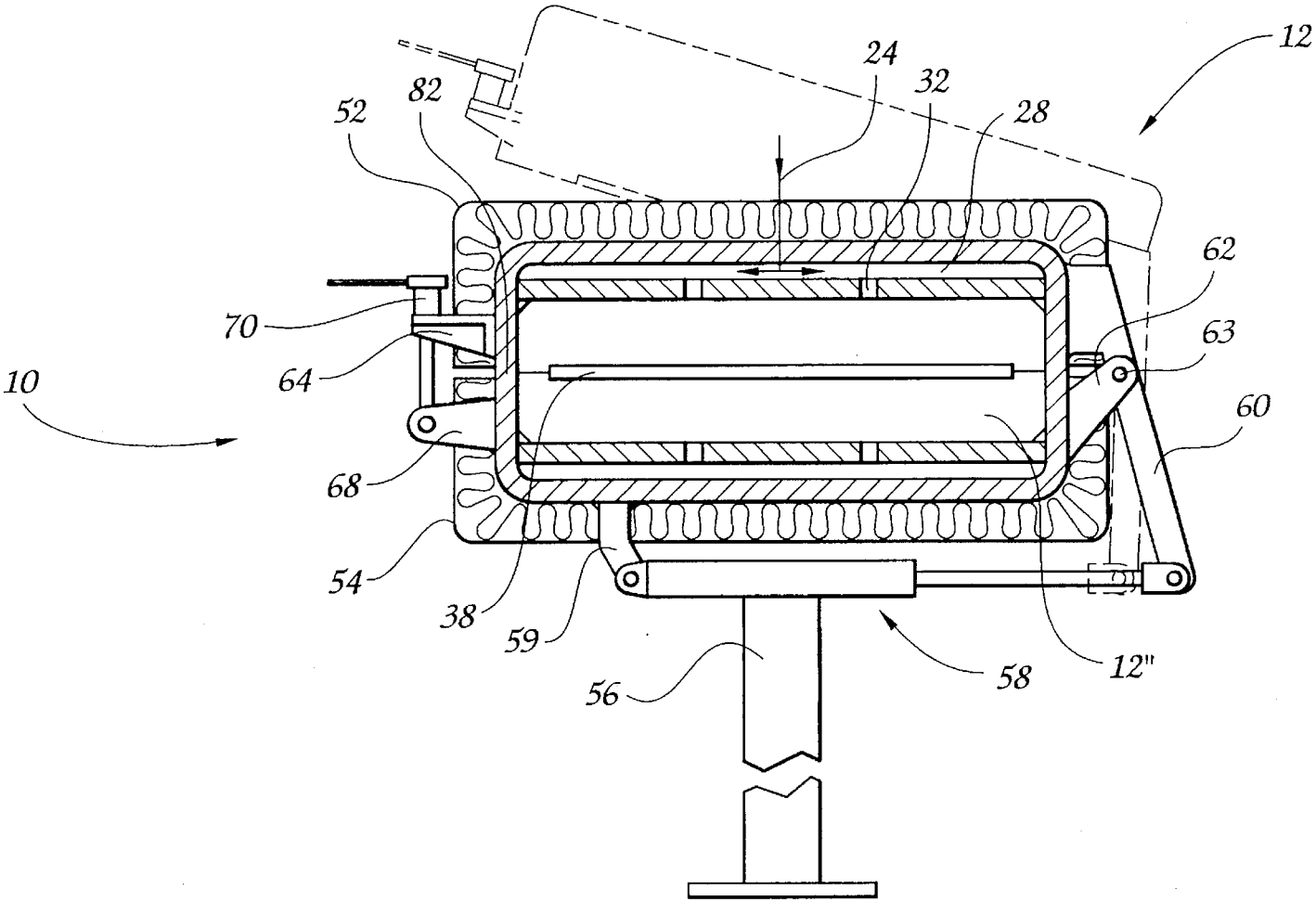
FIG. 4 is a schematic widthwise cross-sectional view of a textile treating apparatus according to the present invention, illustrating the two-portion housing according to another alternative embodiment of the present invention.

In order to facilitate insertion of the textile material M into the apparatus when it is in a warp or sheet form, the entire housing 12 may be divided into an upper housing portion 52 and a lower housing portion 54 as best seen in FIG. 4. The upper housing portion 52 is hingedly mounted to the lower housing portion 54 so that the upper housing portion 52 may pivot upwardly like a clam shell to allow the warp sheet to be laid in place. With continued reference to FIG. 4, the entire housing 12 is mounted on a base pedestal 56 for floor mounting at a predetermined height. An upper hinge member 60 is attached to the upper housing portion 52 and projects downwardly at an angle away from the housing 12. A lower hinge member 62 projects from the lower housing portion 52 into contact with the upper hinge member 60. Openings are provided in each hinge member 60,62 and, when the openings are in registry, a pin 63 is inserted therethrough. The upper hinge member 60 projects downwardly beyond the lower hinge member 62 and terminates at a position slightly below the lower housing member 54. A piston cylinder arrangement 58 is attached to the lower housing 54 using an attachment member 59, with the other end of the piston and cylinder assembly 58 attached to the downwardly projecting end portion of the upper hinge member 60. Therefore, as the piston is drawn into the cylinder, the upper hinge member 60 pivots at its junction with the lower hinge member 62 causing the upper housing portion 54 to rise.

In order to latch the upper housing 52 against the lower housing 54, a latching arrangement is provided comprising a lower latch mount 68 projecting outwardly from the lower housing portion 54 and an upper latch mount 64 projecting outwardly from the upper housing portion 52 and a latching rod 70 extends therebetween. The latching rod 70 is pivotally mounted to the lower latch mount 68 so that it may be swung in and out of interlocking contact with the upper latch mount 64. A sealing gasket 82 is provided around the perimeter of the lower housing 54 at the junction of the lower housing portion 54 and the upper housing portion 52 to seal the entire housing arrangement when both portions are in contact.

Figure 5:
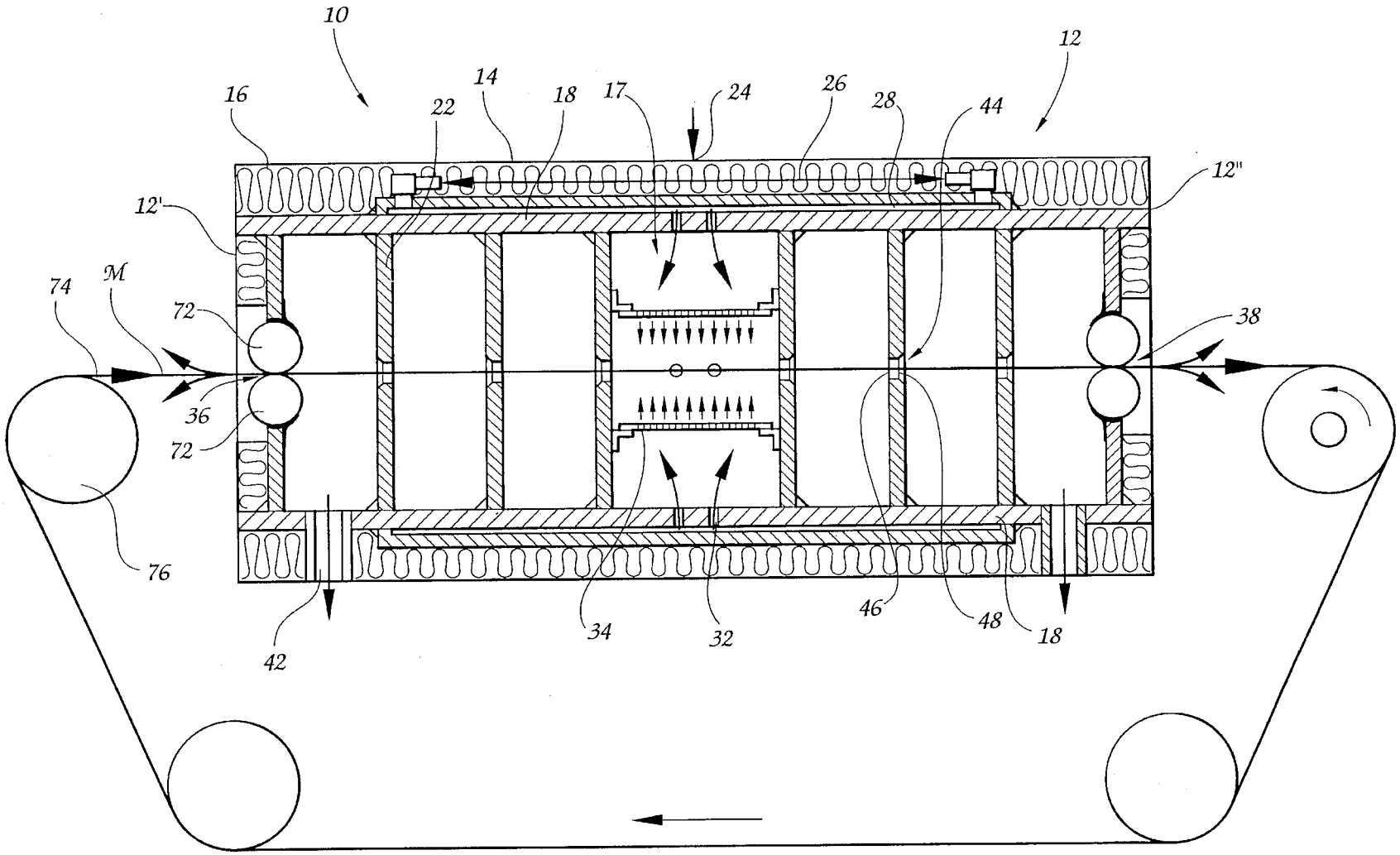
FIG. 5 is a schematic cross-sectional view of a textile material treating apparatus according to another alternative embodiment of the present invention.

Turning now to FIG. 5, another preferred embodiment of the present invention is disclosed. This version is particularly suited for use with fabrics and may be characterized from the other versions by the inclusion of a conveyor 74 formed as an endless belt trained around rollers 76 for feeding fabric through the apparatus 10. A pair of nip rollers 72 is disposed adjacent each of the inlet 36 and the outlet 38 to press the fabric as it enters the apparatus 10. The nip rolls 72 act as a partial seal for the inlet 36 and the outlet 38 to prevent steam spray from contaminating the fabric, or causing a personnel hazard as it enters or leaves the apparatus 10.

Figure 6:
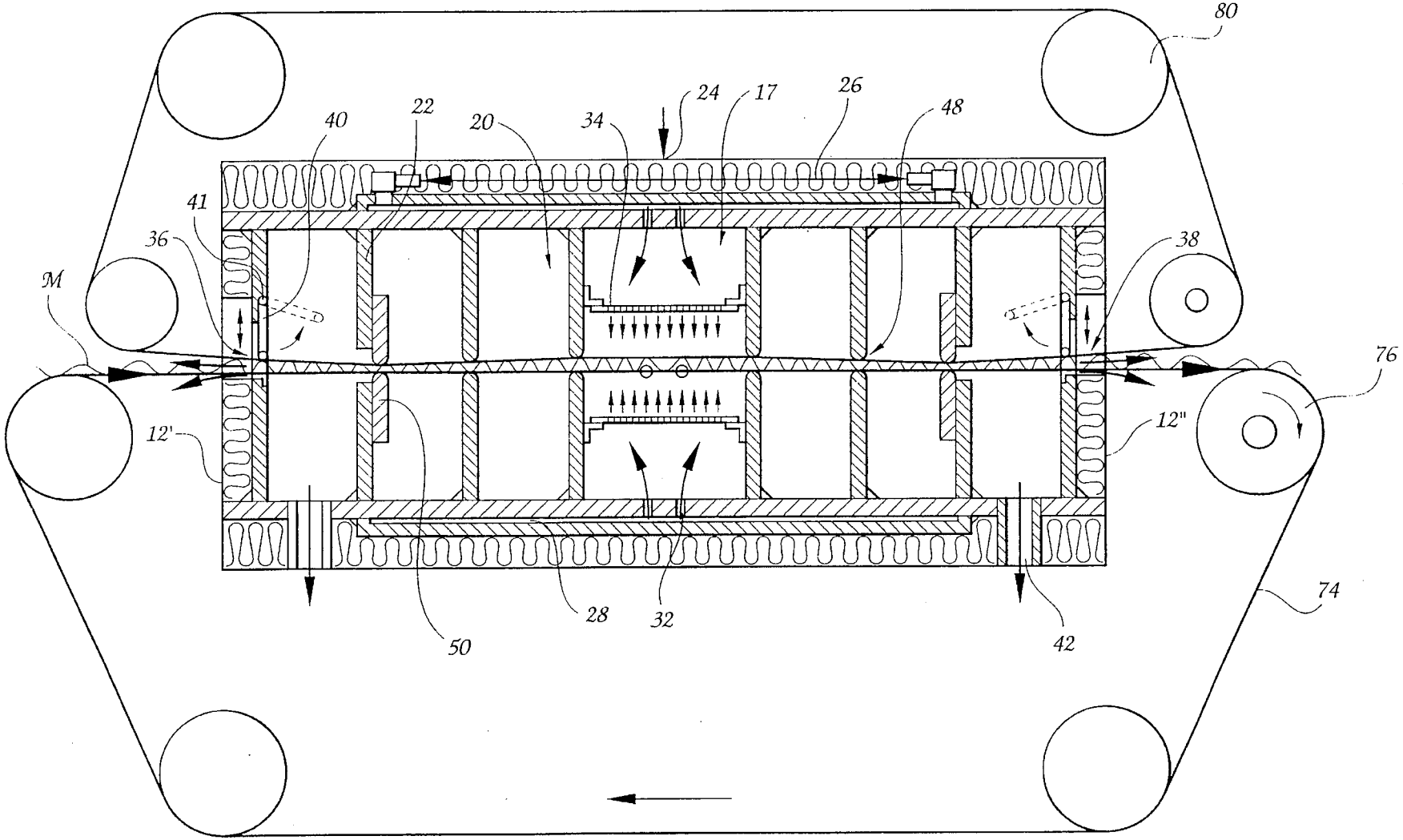
FIG. 6 is a schematic cross-sectional view of a textile treating apparatus illustrating the manner in which textile material may be fed therethrough, according to an alternate embodiment of the present invention.

Another preferred embodiment of the present invention is disclosed in FIG. 6. This embodiment includes two conveyors, a first, lower conveyor 74 which is trained around rollers 76, some of which may be driven, and an upper conveyor 78 which is also trained around rollers 80, some of which may be driven. In this manner, a fabric M may be disposed intermediate the conveyors for passage therethrough. By providing support on both sides of the fabric more uniform treatment can be provided. By the inclusion of two conveyors, the rate of passage of the material is reduced however, the pressure drop is maintained.

By the above, the present invention provides a simple apparatus for steam treating fabrics which is not sealed from the atmosphere yet provides a sufficient pressurized environment to conduct pressure treatment operations on fabrics. The design is compact and easy to operate.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for treating traveling textile material in a pressurized fluid comprising:

housing means including means for forming a textile material inlet and a textile material outlet, said inlet forming means including an opening formed in one end of said housing means for passage therethrough of said traveling textile material, and door means for at least partially covering said inlet opening, said door means being movable between an opened position for feeding textile material through said housing means and a closed position wherein said door means at least partially covers said inlet opening and forms a passageway for free movement of textile material therethrough, a treatment chamber for the application of pressurized treatment fluid to the textile material passing therethrough, a plurality of expansion chambers each having a textile material passageway formed therein, said expansion chambers being disposed upstream and downstream of said treatment chamber in fluid communication therewith for the successive expansion of said treatment fluid between said treatment chamber and the atmosphere, each textile material passageway having an opening formed with a predetermined cross sectional dimension and each said expansion chamber being formed with predetermined dimensions according to a predetermined ratio of passageway size relevant to expansion chamber size for maintaining a pressure drop across each said chamber; and means for delivering pressurized treatment fluid to said treatment chamber including a treatment fluid holding chamber disposed in said housing means in fluid communication with said treatment chamber.

2. An apparatus according to claim 1 and further comprising a treatment chamber for the application of pressurized and superheated steam, said treatment chamber including pressure reducing gates for achieving a high fluid speed to improve the heat transfer to the textile strands.

3. An apparatus for treating traveling textile material according to claim 1 wherein each said expansion chamber has at least one cross sectional dimension which is at least eight times greater than the smallest cross sectional dimension of each said passageway opening.

4. An apparatus for treating traveling textile material according to claim 1 wherein said door means forms a passageway sized in conformance with said predetermined ratio.

5. An apparatus for treating traveling textile material according to claim 1 wherein said outlet forming means includes an opening formed in one end of said housing means for passage therethrough of the textile material after treatment in said treatment chamber, and door means for at least partially covering said outlet opening, said door means being movable between an opened position for feeding textile material through said housing means prior to textile treatment operation and a closed position wherein said door means at least partially covers said outlet opening and forms a passageway for free movement of textile material therethrough.

6. An apparatus for treating traveling textile material according to claim 1 wherein each said passageway is of increasing dimension in the direction outwardly away from said treatment chamber to promote expansion within said expansion chambers of said pressurized treating fluid escaping thereinto.

7. An apparatus for treating traveling textile material according to claim 1 wherein at least one of said expansion chambers includes constriction means for selectively changing the size of said textile material passageway formed in said expansion chamber to selectively control the pressure drop within said chamber by changing the size of said opening relative to the size of said expansion chamber.

8. An apparatus for treating traveling textile material according to claim 7 wherein said constriction means includes a pair of movable panels movably mounted to said housing means for selective movement into and out of a covering relation with said textile material passageway for decreasing or increasing the effective size of said textile material passageway.

9. An apparatus for treating traveling textile material according to claim 1 wherein said housing means includes a lower housing portion and an upper housing portion hingedly mounted thereto and selectively movable between an opened position for insertion of textile material in said housing means for treatment operations and a closed position for treatment operations, said housing means further comprising sealing means for sealing the junction of said upper housing portion and said lower housing portion for preventing said treatment fluid from escaping at said junction.

10. An apparatus for treating traveling textile material according to claim 1 and further comprising means for feeding said textile material through said treatment chamber.

11. An apparatus for treating traveling textile material according to claim 10 wherein said feeding means includes an endless conveyor having a movable material support surface extending through said housing means.

12. An apparatus for treating traveling textile material according to claim 10 wherein said feeding means includes at least two endless conveyors, each endless conveyor having a movable material support surface extending through said housing means whereby said apparatus can treat at least two distinct textile materials substantially simultaneously.

13. An apparatus for treating traveling textile material according to claim 10 wherein said feeding means includes at least two pairs of nip rollers, one pair being disposed adjacent said inlet forming means and one pair disposed adjacent said outlet forming means, said nip rollers being for directing the textile material through said housing means, and means for moving said textile material between said nip rollers and through said housing means.

14. An apparatus for treating traveling textile material according to claim 1 wherein at least one of said expansion chambers includes means for removing treatment fluid therefrom and directing said treatment fluid away from said housing means.

15. An apparatus for treating traveling textile material according to claim 14 wherein said treatment chamber and said expansion chamber are arranged in a series arrangement and said treatment fluid removal means is configured for removing treatment fluid from the first and last expansion chambers in said series arrangement.

* * * * *